United States Patent [19]

Machida

[11] 4,273,042

[45] Jun. 16, 1981

[54] AUTOMATIC SCREEN PRINTING PROCESS AND APPARATUS

[75] Inventor: Saneto Machida, Nishinomiya, Japan

[73] Assignee: Toshin Kogyo Co., Ltd., Hyogo, Japan

[21] Appl. No.: 961,641

[22] Filed: Nov. 17, 1978

[30] Foreign Application Priority Data

Nov. 26, 1977 [JP] Japan ..... 52-141119
Oct. 7, 1978 [JP] Japan ..... 53-124049

[51] Int. Cl.[3] ..... B05C 17/04; B41L 27/00
[52] U.S. Cl. ..... 101/123; 101/115
[58] Field of Search ..... 101/115, 123, 129, 171, 101/211, 114, 116–120, 121, 122, 124

[56] References Cited

U.S. PATENT DOCUMENTS

| | | | |
|---|---|---|---|
| 2,359,825 | 10/1944 | Campbell | 101/115 |
| 3,199,449 | 8/1965 | Jaffa | 101/123 |
| 3,752,070 | 8/1973 | Jaffa | 101/129 |
| 3,921,522 | 11/1975 | Zimmer | 101/129 |
| 3,998,156 | 12/1976 | Zimmer | 101/115 |
| 4,031,823 | 6/1977 | McGee | 101/115 |
| 4,054,091 | 10/1977 | Bradley | 101/115 |
| 4,084,505 | 4/1978 | Ichinose | 101/115 |

*Primary Examiner*—Edgar S. Burr
*Assistant Examiner*—A. Heinz
*Attorney, Agent, or Firm*—Sherman & Shalloway

[57] ABSTRACT

An automatic screen printing process comprising the steps of continuously driving an endless belt to apply and stick a material to be printed onto the endless belt along a predetermined length smaller than one travelling circle of the endless belt, then driving the endless belt intermittently to feed the material to be printed to a printing operation zone and a drying operation zone, while repeating the cycle of the printing operation during stoppage of the endless belt and the operation of travelling the endless belt along a repeat length during stoppage of the printing operation, thereby to print the entire surface of the material applied to the endless belt and dry the printed material, and repeating said printing step until a pattern of a predetermined number of colors is obtained is disclosed.

According to this automatic screen printing process, since a pattern of a predetermined number of colors is printed while turning round an endless belt on which a material to be printed is applied, color pastes are gradually applied to already dried preceding color pastes, bleeding of colors or mingling of color pastes can be prevented, and a printed product having a pattern having sharp contours and very clear colors can always be obtained. Further, since a color paste applied to a material to be printed is immediately dried in drying zone and a subsequent color paste is then applied to the dried color paste, even if a color paste is applied in a considerable thickness or amount, disfiguration of a printed pattern or mingling of colors can be effectively prevented, and as a result, multi-color printing becomes possible with good coloring effects and high printing precision.

2 Claims, 5 Drawing Figures

AUTOMATIC SCREEN PRINTING PROCESS AND APPARATUS

BACKGROUND OF THE INVENTION

1. Field of the Invention

The present invention relates to an automatic screen printing process and apparatus. More particularly, the invention relates to a process and apparatus for manufacturing various kinds of high quality printed products in small lots automatically and stably without performing troublesome manual operations.

2. Description of the Prior Art

According to the conventional manual printing method, a fixed printing stand of a horizontal or inclined type having a length of 25 to 60 m is employed, stencil frame positioning fixtures are attached to the stand at intervals corresponding to the repeat length of a design for moving the stencil frames in the lengthwise direction precisely along the same length, and the operation of moving the stencil frames and the printing operation are carried out in sequence manually based on these positioning fixtures.

In this method, a plain cloth is applied to the surface of the printing stand while manually moving the cloth, and the printed cloth is dried on the printing stand or the printed cloth is once peeled from the printing stand and is then dried in the state hung from a ceiling. After peeling of the printed cloth, the top face of the printing stand is manually washed with water or it is washed with water by means of a simple movable water-washing machine, and after removal of water and application of a paste, a subsequent plain cloth is applied to the surface of the printing stand and the printing operation is then conducted. By repeating such cycle of operations certain times, printing of one lot is completed.

According to the conventional screen-running type semiautomatic printing method, a printing stand similar to the printing stand used in the manual printing method is employed and rails are laid out on both the sides of the printing stand for travelling printing unit-running stands, and fixtures for travelling the running stands in the lengthwise direction of the printing stand in parallel to said rails and precisely positioning the running stands having stencil frames attached thereto are attached to the printing stand at intervals corresponding to the repeat length of a design and a roll of a plain cloth is applied to the surface of the printing stand. Thus, the running stands travel automatically or manually to perform the printing operation, and after completion of the printing operation, the printed cloth is dried on the surface of the printing stand by a movable drying machine or the printed cloth once is peeled from the surface of the printing stand and is then dried in the state hung from a ceiling.

Then, the surface of the printing stand is washed with water manually or by using a movable water washing machine, and after removal of water, a subsequent plain cloth to be printed is applied to the surface of the printing stand. Thus, the above procedures are repeated certain times and printing of one lot is completed.

As will be apparent from the foregoing illustration, not only the manual printing method but also the screen-running type printing method involves a number of manual operation steps and the efficiency of the printing operation is very low. Further, since plain cloths are separately applied every time one cycle of the printing operation is completed, deviations of the quality are conspicuous in printed products of one lot and various disadvantages are caused by such deviation of the quality.

OBJECTS OF THE INVENTION

It is therefore a primary object of the present invention to provide an automatic screen printing process and apparatus in which a variety of high quality printed products of small lots, which have heretofore been manufactured by manual printing or screen-running type printing methods, can be manufactured automatically at a high efficiency stably without deviations of the quality.

Another object of the present invention is to provide an automatic screen printing process and apparatus in which the printing operation can always be accomplished under constant cloth-applying and printing conditions even if a worker is not experienced.

Still another object of the present invention is to provide an automatic screen printing process and apparatus in which application of a material to be printed to an endless belt is performed by continuously driving the endless belt and the material is applied entirely along the peripheral face of the endless belt, whereby the material to be printed can always be applied under a certain tension, the printing operation can be performed at a high precision even on a flexible material, and a maximum applicable length of a material to be printed can be prolonged to the length of one travelling circle (circumference) of the endless belt and therefore, the equipment space of the printing apparatus can be reduced to ½ of the equipment space necessary for the conventional fixed type printing stand.

A further object of the present invention is to provide an automatic screen printing process and apparatus in which a predetermined number of colors are printed while an endless belt to which a material to be printed is applied turns round through printing and drying zones repeatedly, so that color pastes are applied on already dried preceding color pastes, whereby bleeding of colors and mingling of color pastes can be prevented and printed products having clear colors and sharp pattern contours can always be obtained.

SUMMARY OF THE INVENTION

In accordance with one fundamental aspect of the present invention, there is provided an automatic screen printing process which comprises the steps of:

(A) continuously driving an endless belt travelling through a pasting operation zone, a printing operation zone, a drying operation zone and a washing operation zone, thereby to apply a material to be printed onto the endless belt along a predetermined length smaller than one travelling circle of the endless belt, and cutting the material to be printed into said predetermined length according to need, (B) travelling said endless belt onto which the material to be printed has been applied, to a position for starting the printing operation, (C) intermittently driving the endless belt to deliver the material to be printed to the printing operation zone and drying operation zone and thereby repeating the cycle of operations of performing printing during stoppage of the endless belt and feeding the endless belt along a repeat length during stoppage of the printing operation, whereby the entire surface of the material to be printed, which has been applied to the endless belt, is printed and the printed material is dried, (D) repeating said steps (B) and (C), according to need, to print a desirable number of colors on the entire surface of the material to be printed, which has been applied to the endless belt, and (E) continuously driving said endless belt to peel off the printed and dried material as a printed product from the endless belt and washing the endless belt in the washing operation zone.

In accordance with the other fundamental aspect of the present invention, there is provided an automatic screen printing apparatus comprising an endless belt laid out to travel through a pasting operation zone, a printing operation zone, a drying operation zone and a washing operation zone by means of a pair of pulleys, a servo drive mechanism for driving said endless belt intermittently and continuously through said pulleys, a pasting mechanism disposed in the pasting operation zone so that it can engage with and separate from the endless belt, a mechanism for feeding to the endless belt a material to be printed and applying and sticking the material to the endless belt, a printing unit disposed in said printing operation zone, said printing unit including a screen, a squeegee capable of scanning on the screen and a squeegee driving mechanism, a lift mechanism for driving and moving the printing unit in the vertical direction between a lowermost printing position and an uppermost non-printing position, a drying device disposed in said drying operation zone, a mechanism for peeling off a printed product from the endless belt, a washing mechanism disposed in the washing operation zone so that it can engage with and separate from the endless belt, a positioning mechanism for correctly registering the material to be printed with a position for starting the printing operation, and a drive control mechanism for continuously driving said servo drive mechanism for applying the material to be printed onto the endless belt along a predetermined length and intermittently driving said servo drive mechanism for travelling the endless belt intermittently by a predetermined repeat length along the entire surface of the material to be printed, wherein said pasting mechanism and washing mechanism are connected to said drive control mechanism so that the pasting and washing mechanisms are allowed to fall in agreement with the endless belt only when the endless belt is continuously driven, and wherein said lift mechanism and squeegee driving mechanism are connected to said drive control mechanism so that dropping of the printing unit to the lowermost position is performed on confirmation of the repeat length feeding of the material to be printed, scanning movement of the squeegee is performed on confirmation of completion of dropping of the printing unit to the lowermost position, elevation of the printing unit to the uppermost position is performed on confirmation of completion of scanning movement of the squeegee and driving of the endless belt is performed on confirmation of elevation of the printing unit to the uppermost position.

In accordance with one preferred embodiment of the above-mentioned automatic screen printing process of the present invention, prior to or simultaneously with printing of a first color, marks for respective feedings are printed on the surface of the endless belt and at printing of each of subsequent colors, the corresponding feeding mark is detected to control the feed length of the endless belt.

In accordance with one preferred embodiment of the above-mentioned automatic screen printing apparatus of the present invention, the printing unit further includes a mechanism for printing marks for respective feedings on the surface of the endless belt prior to or simultaneously with printing of a first color, a detecting mechanism is disposed in the printing operation zone or in an area adjoining to the printing operation zone to detect said marks and a control mechanism is disposed to stop said servo drive mechanism in response to a signal issued from said mark detecting mechanism to control the feed length of the endless belt.

In the conventional automatic printing process and apparatus in which an endless belt to which a material to be printed has been applied is intermittently fed to a printing operation zone by intermittent movement of pulleys, the intermittent feed length of the belt is naturally determined by the rotation angle of the pulleys and the precision of this feeding is influenced by errors of the thickness, hardness and elongation of the endless belt, changes of properties of the belt caused by changes of the ambient temperature and humidity, especially the thermal influence of an annexed drying device, and expansion and contraction of the driving pulleys caused by changes of the ambient temperature, rather than by the degree of the mechanical precision at driving or stopping of a driving roller. Accordingly, in the conventional automatic screen printing process and apparatus, it is very difficult to always maintain a high precision in the feed length of the endless belt.

Further, in the conventional automatic screen printing process and apparatus of this type, the endless belt travels and turns round several times according to the number of colors to be printed, and since there is present a considerable lapse of time between the point of printing of a first color and the point of printing of a last color, the feed length of the endless belt is gradually changed during this time because of the above-mentioned various influences and it is very difficult to maintain a precise feed length of the endless belt throughout the printing operation.

In contrast, according to the above-mentioned preferred embodiments of the present invention, the foregoing defects involved in the above-mentioned conventional automatic screen printing technique utilizing pulleys for intermittent feeding of the endless belt can be completely eliminated, and multi-color printing can be performed always at a high feed precision irrespectively of the above-mentioned factors having influences on the feed length of the endless belt and this high precision in the feeding of the endless belt can be maintained even to the step of printing of a final pattern.

In accordance with an especially preferred embodiment of the present invention, the feed length (repeat length) of the endless belt is set as a pulse number, the actual fed length of the endless belt is detected as a number of pulses, digital control is performed so that reduction of the speed of the endless belt and stopping of movement of the endless belt are performed depending on the difference between the set pulse number and the number of the actually detected pulses according to a program and this digital control is combined with the above-mentioned mark-detecting feed length control for performing reduction of the speed of the endless belt and stopping of movement of the endless belt on detection of marks printed on the surface of the endless belt, whereby a very high precision can always be maintained in the feed length of the endless belt.

The present invention will now be described in details by reference to the accompanying drawing.

DETAILED DESCRIPTION OF THE PREFERRED EMBODIMENTS

Figure 1:
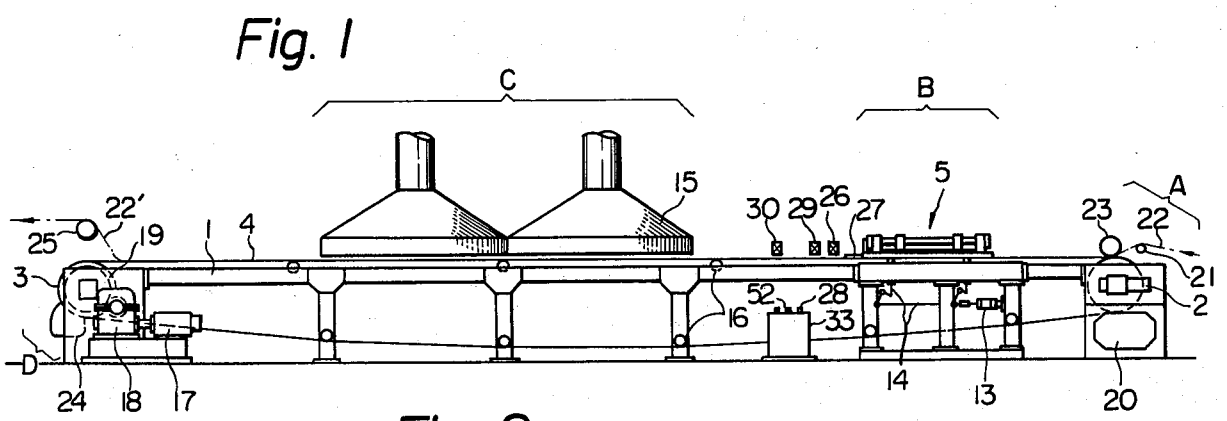
FIG. 1 is a side view showing one preferred embodiment of the automatic screen printing apparatus of the present invention.
Figure 2:
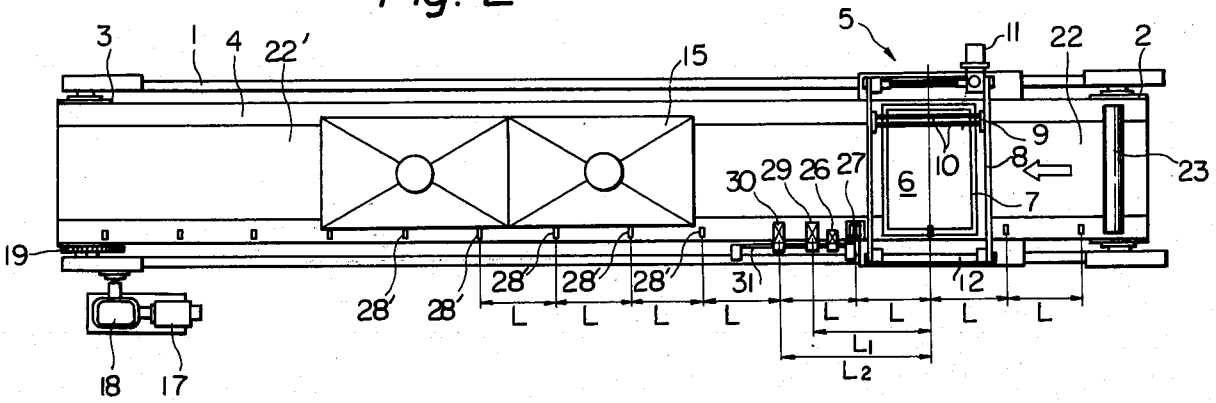
FIG. 2 is a plan view showing the printing apparatus illustrated in FIG. 1.

Referring to FIGS. 1 and 2, a driven pulley 2 and a driving pulley 3 are mounted on both the ends of a machine frame 1, and an endless belt 4 is stretched between these pulleys so that the belt 4 travels through a pasting operation zone A, a printing operation zone B, a drying operation zone C and a washing operation zone D.

A printing unit 5 having a known structure is disposed on the upper side of the belt 4 in the printing operation zone B and a stool (not shown) as a printing stand is disposed on the lower side of the belt 4 in the printing operation zone. This printing unit 5 includes a screen 6, a stencil frame 7 for supporting the screen 6, a squeegee 10 disposed scannably on the screen 6 through guide rail 8 and carrier 9, and a squeegee driving mechanism 11 (motor). The screen-supporting stencil frame 7 is easily dismountably attached to a printing unit supporting stand 12, and a plurality of squeegees 10 are arranged so that they are moved to scan on the screen and the moving direction is reversed on both the ends of the screen by the carrier 9.

A lift mechanism having a known structure is disposed to move the printing unit 5, namely the supporting stand 12, in the vertical direction between the lowermost printing position (the position shown in FIG. 1) and the uppermost non-printing position, and this lift mechanism includes a fluid cylinder 13 and a series of a link mechanism 14.

The drying operation zone C is located subsequently to the above-mentioned printing operation zone B on the running passage of the endless belt 4, and a known drying mechanism 15 such as a hot air drier, an infrared lamp or an electric heater is disposed in the drying operation zone C.

In order to tightly support the endless belt 4 in portions other than the portion supported by the stool, a plurality of guide rolls 16 may be arranged on the running passage of the belt 4.

A servo driving mechanism 17 (motor) having a known structure is disposed to drive the driving pulley 3 to thereby drive the endless belt 4 intermittently and continuously around the driving pulley 3. The driving force of the servo drive mechanism 17 is transmitted to the driving pulley 3 through a reduction gear 18 and a spur gear 19.

On the side of the machine frame 1 where the driven pulley 2 is located, the pasting operation zone A is formed, and a pasting device 20 having a known structure is disposed in the pasting operation zone A so that it can engage with and separate from the endless belt 4.

On the side of the machine frame 1 where the driven pulley 2 is located, a feed mechanism 21 having a known structure is disposed to feed a plain cloth 22 to be printed, and the cloth 22 is fed onto the paste-applied belt 4 and the fed cloth 22 is caused to adhere to the belt 4 by means of a sticking roller 23.

On the side of the machine frame 1 where the driving pulley 3 is located, the washing operation zone D is formed, and a washing device 24 having a known structure is disposed in this washing operation zone D so that the washing device 24 can engage with and separate from the endless belt 4.

Further, on the side of the machine frame 1 where the driving pulley 3 is located, a guide roll 25 is disposed to peel off a printed product 22' from the belt 4 and guide it to a known winding device (not shown).

A mechanism 26 for registering the printing-starting end of the material 22 to be printed with the standard (leading) end of the screen on the endless belt 4 is mounted on the machine frame 1.

A drive control switch 28 is mounted on an operation panel 33 (see FIG. 1) attached to the machine frame 1 to drive the servo drive mechanism 17 continuously for applying a predetermined length of the material 22 to be printed to the endless belt 4 and also to drive the servo drive mechanism 17 intermittently for feeding the endless belt 4 by a predetermined repeat length toward the printing operation zone along the entire surface of the material to be printed.

The pasting mechanism 20 and washing mechanism 24 are electrically connected to the drive control switch 28 so that these mechanisms are allowed to fall in contact with the belt 4 only when the belt 4 is continuously driven.

The lift mechanism 13 and squeegee driving mechanism 11 can be operated only when the belt 4 is driven intermittently, and they are electrically connected to the drive control mechanism 28 so that by using known limit switch means (not shown), dropping of the printing unit 5 to the lowermost position (printing position) is performed on confirmation of feeding of the material 22 along the repeat length, scanning driving of the squeegee 10 is performed on confirmation of dropping of the printing unit 5 to the lowermost position, elevation of the printing unit 5 is performed on confirmation of completion of the scanning movement of the squeegee 10 and driving of the endless belt 4 is performed on confirmation of elevation of the printing unit 5 to the uppermost position (non-printing position).

In the present invention, it is especially preferred that prior to or simultaneously with printing of a first color, marks for respective feedings be printed on the surface of the endless belt and at printing of each of subsequent colors, the corresponding feeding mark be detected to control the feed length of the endless belt. For embodying this feature, a mechanism 27 for printing marks for respective feedings on the surface of the endless belt prior to or simultaneously with printing of a first color is mounted on the printing unit 5. This mechanism 27 comprises, for example, a small screen device and marks 28' are printed on the surface of the belt 4 by a known squeegee device (not shown). The marks 28' are printed directly on the belt surface, and the intended detection can be sufficiently attained if the size of these marks is one that can be detected by, for example, a photoelectric device. In case of an endless belt having a surface portion composed of a black material, such as an ordinary endless belt, an aqueous or oily ink of a bright color such as a white ink or yellow ink for ordinary printing is used for printing of these marks. Of course, when marks 28' are printed on a white background of an endless belt, a black or brown ink may be used for printing of these marks. Instead of the small screen device 27 disposed independently from the printing screen 6, a stencil pattern may be formed only on the screen 6 of a first color for printing marks on the belt surface so that by reciprocative scanning movements of the squeegee 10 and a flood doctor (not shown), printing of marks can be accomplished simultaneously with the printing operation. Further, if there is a margin in the material to be printed, these marks may be printed on such margin of the material to be printed.

At the subsequent printing operation, namely at the operation of printing a first color or second color and subsequent colors in the above-mentioned preferred embodiment, these marks 28' are detected by detecting mechanisms 29 and 30 disposed in the printing operation zone or in the vicinity of the printing operation zone. For example, such detecting mechanism comprises a photoelectric device for detecting marks 28' by reflection of rays, and it is preferred that such detecting mechanism be constructured by a pair of a detecting device 29 located in the front to issue signals for reduction of the speed and a detecting device 30 located in the rear to issue stopping signals.

These indicating devices 29 and 30 are disposed on a shaft 31 of the machine frame 1 so that they can slide on the shaft 31, if necessary together with the abovementioned positioning mechanism 26 and their positions can be adjusted with respect to the direction of advance of the belt. The distances $L_1$ and $L_2$ from the center of the printing screen 6 can optionally be adjusted according to the belt feed length L (repeat length) or the belt feed velocity (in the embodiment shown in FIG. 2, a relation of $L_2=2L$ is established but establishment of this relation is not an indispensable requirement in the present invention).

In the present invention, it is especially preferred that the feed length of the endless belt be controlled by a combination of (i) pulse control where the repeat length (feed length) of the endless belt is set as a pulse number, the actual fed length of the endless belt is detected as a number of pulses and reduction of the speed of the endless belt and stopping of movement of the endless belt are performed depending on the difference between the set pulse number and the number of the actually detected pulses and (ii) mark-detecting control where marks on the belt surface are detected and reduction of the speed of the endless belt and stopping of movement of the endless belt are performed on detection of these marks.

Figure 3:
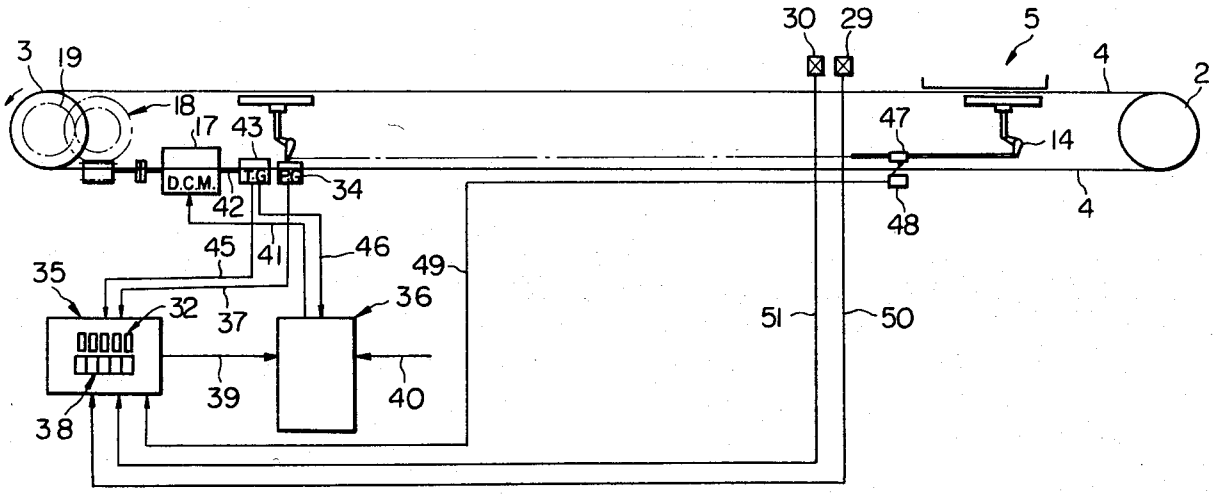
FIG. 3 is a block diagram of the control mechanism of the printing apparatus illustrated in FIG. 1.

In a digital drive control mechanism preferably employed in the present invention, which is diagrammatically illustrated in FIG. 3, a direct current electric motor 17 for driving the endless belt 4, a switch 32 for setting the repeat length as a pulse number, a repeat length detecting mechanism 34 for detecting the actual fed length of the endless belt 4 as a number of pulses, a digital control mechanism 35 and an electric motor control mechanism 36 for controlling an electric input to the direct current electric motor 17 are arranged so that specific relationships described hereinafter should be established among these members.

In order to drive the endless belt 4 strictly according to an electrically controlled program, it is preferred to use the direct current electric motor 17.

The switch 32 is mounted on an operation panel of the digital control mechanism 35, and the repeat length of the endless belt 4 is set to a desirable value as a pulse number.

The repeat length detecting mechanism for detecting the actual feed length of the endless belt 4 comprises a pulse generator 34 connected directly to a driving shaft 42 of the electric motor 17. This pulse generator 34 is capable of generating signals of a predetermined pulse number precisely in correspondence to the displacement angle of a rotation shaft (not shown) thereof. Of course, instead of this method in which the pulse generator 34 is directly connected to the driving shaft 42, there may be adopted a method in which the linear displacement (feed length) of the endless belt is converted to an angular displacement and this angular displacement is transmitted to the rotation shaft of the pulse generator 34 or the angular displacement of the pulley 3 is directly transmitted to the rotation shaft of the generator 34.

Pulse signals from the pulse generator 34 are transmitted to the digital control mechanism 35 through a line 37. Such pulse signal is displayed as an actual feed length on a digital display area 38 formed on an operation panel of the digital control mechanism 35.

In the digital control mechanism 35, subtraction is conducted between the pulse number set by the switch 32 and the pulse number detected through the pulse generator 34, and a speed reduction signal is generated so as to stop the direct current electric motor 17 at the set pulse number.

The electric motor control mechanism 36 ordinarily comprises a thyristor panel, and a speed reduction signal from the digital control mechanism 35 is supplied as an SCR gate signal to the thyristor panel 36 through a line 39. An electric input applied from a power source 40 to the direct current electric motor 17 through the thyristor panel 36 and line 41 is controlled based on the abovementioned SCR gate signal (speed reduction signal) to reduce the velocity of the electric motor 17 and stop the electric motor 17 at the set pulse number. A tachometer 43 for detecting the actual rotation speed of the direct current electric motor 17 as a voltage is connected to the driving shaft 42 of the direct current electric motor 17, and a detection signal from the tachometer 43 is fed to a digital regulator 35 through a line 45 and fed back to the electric motor control mechanism 36 through a line 46.

It is advantageous that driving of the direct current electric motor 17 is performed after arrival of the printing unit 5 at the uppermost position has been confirmed. For embodying this feature, a projection 47 is formed on the lifting frame driving mechanism 14 so that when the printing unit 5 is located at the uppermost position, this projection 47 is detected by a limit switch 48. A detection signal of the limit switch 48 is fed to the digital control mechanism 35 through a line 49.

Figure 4:
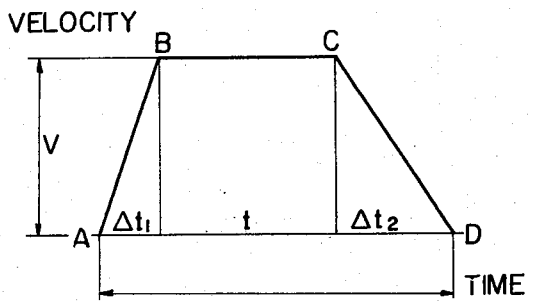
FIG. 4 is a curve illustrating the operation of the endless belt at the step of printing marks.

Referring to FIG. 4 illustrating the relation between the belt feed velocity and the time at the step of printing of marks, the feed stroke of the belt 4 comprises an acceleration driving region AB, a constant speed driving region BC and a speed reduction-stopping region CD, and the stoppage period DA follows this feed stroke and both such feed stroke and stoppage period constitute one cycle of the printing operation. In FIG. 4, the area surrounded by lines AB, BC, CD and DA corresponds to the feed length of the belt.

In the relation illustrated in FIG. 4, the feed length L (m) of the belt is represented by the following formula:

$$L = V\left(t + \frac{\Delta t_1}{2} + \frac{\Delta t_2}{2}\right) \quad (1)$$

wherein $\Delta t_1$ stands for the time (sec) of the acceleration driving, t stands for the time (sec) of the constant speed driving, $\Delta t_2$ stands for the time (sec) of the speed reduction-stopping, and V stands for the velocity (m/sec) of the belt at the constant speed driving.

In the foregoing formula (1), values of V, $\Delta t_1$ and $\Delta t_2$ are determined by the mechanical structure of the printing apparatus and the capacity of the direct current electric motor 17.

In the printing apparatus of the present invention, at the step of printing of marks on the belt surface prior to or simultaneously with printing of a first color, the digital control mechanism 35 and electric motor control mechanism 36 (thyristor panel) are set so that the endless belt 4, namely the direct current electric motor 17, is driven according to the diagram of FIG. 4. More specifically, the repeat length is set as a pulse number by the switch 32, and in the digital control mechanism 35, pulse numbers corresponding to the respective operation times $\Delta t_1$, t and $\Delta t_2$, namely $N\Delta t_1$, Nt and $N\Delta t_2$ in which N designates the pulse number per unit time (Hz/sec), are set.

Control of the driving of the endless belt at the mark-printing step is performed according to the following procedures.

(i) On receipt of the detection signal from the limit switch 48, the digital control mechanism 35 emits an acceleration signal to the electric motor control mechanism 36 and an acceleration current is supplied to the direct current electric motor 17 based on this signal. Accordingly, the endless belt 4 is driven and accelerated along the line AB in FIG. 4.

(ii) The digital control mechanism 35 counts the pulse number $\Delta t_1 N$ and/or confirms from the detection signal from the tachometer 34 that the rotation speed of the electric motor 17 arrives at a level corresponding to the velocity V of the constant speed driving of the belt. At this point, the digital control mechanism 35 emits a constant speed driving signal to the electric motor control mechanism 36, and on receipt of this signal, the electric motor control mechanism 36 supplies a constant speed driving electric current to the direct current electric motor 17 to drive at a constant speed the direct current electric motor 17, namely the endless belt 4, along the line BC in FIG. 4.

(iii) The digital control mechanism performs subtraction between the pulse number ($N_S$) set by the switch 32 and the pulse number ($N_D$) detected by the feed length detecting mechanism, and when the difference ($N_S - N_D$) corresponds to the value represented by the following formula:

$$N_S - N_D = \Delta t_2 N \quad (2)$$

in which $N_S$ is equal to $N\Delta t_1 + Nt + N\Delta t_2$, the digital control mechanism 35 emits a speed reduction signal to the electric motor control mechanism 36. On receipt of this signal, the electric motor control mechanism 36 supplies a speed reduction electric current to the direct current electric motor 17. Accordingly, the speed of the electric motor 17, namely the endless belt 4, is reduced along the line CD in FIG. 4 and the electric motor 17 is stopped to stop the endless belt 4. Speed reduction and stopping of the direct current electric motor are performed by reference to the detected pulse signal from the feed length detecting mechanism 34 and the voltage signal from the tachometer 43 so that the endless belt 4 is stopped precisely at the repeat length corresponding to the set pulse number. The speed reduction current may be supplied in the form of so-called electric brake to the electric motor.

Any of known mechanisms can be used as the digital control mechanism 35 in the present invention, and preferred examples are Digital DC Servo Model DDS-P manufactured by Nippon Reliance Kabushiki Kaisha and Position Pack Model 300, each of which is easily commercially available.

From the operation facility and the simplicity of the mechanism, it is preferred that the adjustment of the repeat length of the belt 4 be performed by changing the feed time of the belt, especially the constant speed driving time (t). Further, this adjustment can be accomplished by changing the velocity (V) of the constant speed driving by keeping the total feed time ($\Delta t_1 + t + \Delta t_2$) substantially constant.

At the step of printing of a first color or second color or any subsequent color, driving of the endless belt is controlled by detection of marks. For accomplishing this control, the detecting device 29 for generating speed reduction signals is connected to the digital control mechanism 35 through a line 50 and the detecting device 30 for generating stopping signals is connected to the digital control mechanism 35 through a line 51.

Figure 5:
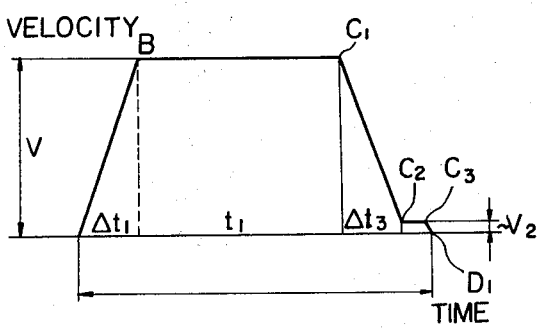
FIG. 5 is a curve illustrating the operation of the endless belt at the step of detecting marks.

Referring to FIG. 5 illustrating the relation between the belt feed velocity and the time at the step of printing of a first or second color or any of subsequent colors, the feed stroke of the endless belt 4 comprises an acceleration driving region AB, a constant speed driving region $BC_1$ and the speed reduction-stopping region $C_1C_2C_3D_1$. The acceleration driving and constant speed driving of the belt are performed in the same manner as described above by reference to FIG. 4. When the detecting device 29 for generating speed reduction signals detects a mark 28' [the feed length Lo of the belt 4 corresponds to $$V\left(t_1 + \frac{\Delta t_2}{2}\right)],$$

the digital control mechanism 35 emits a speed reduction signal to the electric motor control mechanism 36 based on the detection signal from the detecting device 29. Accordingly, the electric motor control mechanism 36 supplies a speed reduction electric current to the direct current electric motor 17, and the speed of the electric motor 17, namely the belt 4, is reduced along the line $C_1C_2$ in FIG. 5 and the belt 4 is then driven at a very slow constant speed $V_2$.

When the detecting device 30 for generating stopping signals then detects the mark 28', based on the detection signal from the detecting device 30, the speed of the electric motor 17, namely the endless belt 4, is reduced and the endless belt 4 is stopped by the digital control mechanism 35 and the electric motor control mechanism 36 as indicated by the line $C_3D_1$ in FIG. 5.

The speed reduction driving time $\Delta t_3$ of the belt 4 is set so that the relation represented by the following formula:

$$L - \Delta L \geqq V(t_1 + \frac{\Delta t_1}{2} + \frac{\Delta t_3}{2}) \quad (3)$$

wherein L stands for the set feed length of the belt, $\Delta L$ designates a maximum contraction error of the belt and $t_1$, $\Delta t_1$ and $\Delta t_1$ and $\Delta t_3$ are as defined above, is established. By this arrangement, it is made possible to perform feeding of the endless belt at a high precision by detecting the marks.

In the printing apparatus illustrated in FIGS. 1 to 3, the printing operation is performed according to the following procedures.

(A) Step of Printing Marks

At first, the drive control switch 28 on the operation panel 33 is turned over for continuous driving, thereby to drive the endless belt 4, and by the positioning mechanism 26, the printing-starting end of the endless belt 4 is registered with the standard end of the printing unit 5.

Subsequently, the switch 28 is turned over for intermittent driving, and an intermittent driving switch 52 (see FIG. 1) on the operation panel 33 is turned over for digital control.

At the point of starting printing of marks, a compression fluid is supplied to the fluid cylinder 13 and by the operation of the fluid cylinder 13, the printing unit 5 is brought down and is stopped at the lowermost printing position. In this state, an ink is applied to the surface of the belt 4 through the mark-printing stencil to print marks 28' on the surface of the belt 4.

This operation of printing of marks 28' may be performed automatically or manually by using a known squeegee mechanism (not shown). When the squeegee operation is carried out automatically, the printing unit 5 is operated in the following manner as described in detail hereinafter. Namely, on confirmation of dropping of the printing unit 5 by a limit switch (not shown), the squeegee is driven to perform to scanning movement, and on confirmation of completion of the scanning movement of the squeegee by a limit switch (not shown), elevation of the printing unit 5 and initiation of driving of the endless belt are performed. When printing of marks is manually conducted, it is possible to drive the belt 4 intermittently after a certain stoppage time.

On confirmation of elevation of the printing unit 5 to the uppermost position by a limit switch 48 ( see FIG. 3), the endless belt 4 is intermittently fed by the set feed length (L) according to the program described in detail hereinbefore by reference to FIGS. 3 and 4. Every time feeding of the belt 4 is stopped, one mark is printed on the belt surface. Thus, a great number of detecting marks 28' are formed at intervals L along the entire peripheral surface of the belt 4.

(B) Step of Preparation for Printing

When the drive control switch 28 on the operation panel 33 is then turned over for continuous driving, the endless belt 4 is continuously driven through the direct current electric motor 17 and reduction gear 18, and simultaneously, the pasting mechanism 20 is operated to apply a paste to the belt surface. A material 22 to be printed is fed under an appropriate tension onto the endless belt 4 and is applied and stuck to the belt 4 by the sticking roll 23. The material 22 is applied to the endless belt 4 continuously along a necessary printing length which is smaller than one travelling circle of the endless belt 4. Stopping of continuous driving of the endless belt 4 can be done after it has been confirmed that the material 22 to be printed has been applied and stuck to the belt along a predetermined length. This confirmation is accomplished by visual observation of a worker or by putting off the above-mentioned cloth-sticking switch or drive control switch, or the confirmation can be automatically accomplished by detecting the rear end of the material 22 having a predetermined length. The material 22 to be printed may be cut into a predetermined length in advance and then fed onto the belt, or the material 22 may be cut by an appropriate cutting mechanism (not shown) when it is applied onto the belt 4 along a predetermined length. Of course, cutting of the material 22 to be printed may be done by a manual operation using scissors, a knife or the like.

According to the printing process of the present invention, since application of a paste and sticking of a material 22 to be printed are performed while continuously driving the endless belt 4, uneven application of the paste or occurrence of uneven tension is not caused. Therefore, it is possible to apply and stick a material to be printed onto the endless belt under a constant tension stably in a constant state, and the printing operation can be accomplished at a very high precision. This advantage is especially prominent when the material to be printed is a cloth or fabric having a high flexibility. Of course, a tension to be applied to a cloth or the like may be adjusted by means for a known feed device, or a cloth or the like may be expanded or subjected to a special treatment for correcting meandering. Further, the amount applied of a paste or the paste-applying width may optionally be adjusted by means of the pasting device.

Then, the endless belt 4 is further driven continuously, and the printing-starting end of the material 22 applied onto the endless belt 4 is registered with the standard end of the printing unit 5 by the positioning mechanism 26.

At initiation of the printing operation, the stencil frame 7 provided with the screen 6 having a predetermined stencil pattern is attached to the printing unit and a predetermined color paste (not shown) is fed onto the screen 6.

(C) Printing Step

In the above-mentioned state, the intermittent drive switch 52 is turned over for detection of marks, and the printing operation is started.

On initiation of the printing operation, a compression fluid is supplied to the fluid cylinder 13 to actuate the cylinder 13 to bring down the printing unit 5 and stop the unit 5 at the printing operation position. Then, dropping of the printing unit 5 to the printing operation position is confirmed by a limit switch (not shown), and the squeegee driving motor 11 is operated to drive the squeegee 10 attached to the squeegee carrier 9 and cause the squeegee 10 to make scanning movement, whereby the printing operation is performed. Arrival of the squeegee 10 at the position of completion of scanning movement is confirmed by a limit switch (not shown) or the like, and the squeegee 10 is stopped or the squeegee 10 and doctor (not shown) are changed over or returned. Further, the printing unit 5 is lifted up by the fluid cylinder 13. Arrival of the printing unit 5 at the uppermost position is confirmed by a limit switch (not shown) or the like, and then, driving of the endless belt 4 is started through the motor 17 and reduction gear 18.

The intermittent feeding of the endless belt 4 is performed by the control mechanism described in detail hereinbefore by reference to FIGS. 3 and 5, and the endless belt 4 is stopped precisely at the position where the mark 28' on the belt is detected by the detecting device 30 and the printing operation of the subsequent cycle is carried out in succession. The foregoing printing procedures are repeated along the entire length of the material 22 applied to the endless belt 4.

With the intermittent feeding of the endless belt 4, the printed material is intermittently fed to the drying operation zone C adjoining to the printing operation zone B, and the applied color paste is dried by the drying device 15.

At the point when printing of a first color and drying are completed to the terminal end of the material 22 applied to the endless belt, the intermittent driving of the endless belt 4 is stopped. Then, the stencil frame and squeegee of the printing unit 5 are exchanged for those for printing of a second color, and if necessary, the drive control switch 28 is turned over for continuous driving to register the printing-starting end of the material 22 on the endless belt 22 with the standard end of the screen 6.

Then, the drive conrol switch 28 is turned over for intermittent driving and the printing operation and drying operation are automatically performed even to the terminal end of the material 22 by the intermittent feedng of the endless belt in the same manner as in case of printing of the first color.

After completion of printing of the second color, printing of a third color, a fourth color and subsequent colors of a predetermined number is performed according to the foregoing procedures while circulating the endless belt 4 in the state where the material to be printed is applied and stuck to the endless belt 4.

According to the present invention, since printing of a predetermined number of colors is performed while circulating the belt 4 having the material 22 applied and stuck thereto, color pastes are sequentially applied to already dried preceding color pastes, and hence, bleeding or mingling of color pastes is prevented and printed products having clear colors and sharp contours can always be obtained. Further, since a color paste applied to a material to be printed is immediately dried in the drying operation zone and a subsequent color paste is applied thereto, even if color pastes are applied on a material to be printed in a large quantity and a considerable thickness, disfiguration of patterns or mingling of colors can be effectively prevented, and multi-color printing can be advantageously accomplished with good coloring effects at a high printing precision.

Moreover, according to the preferred embodiments of the present invention, by controlling the feeding of the endless belt at the printing step by detecting marks printed on the surface of the belt, even if there is present a long lapse of time between the point of printing of a first color and the point of printing of a last color or the belt is influenced by the heat applied at the drying step, a very high feed precision can always be maintained and occurrence of such troubles as shear in colors can be effectively eliminated.

(D) Post-Treatment Step

When printing of a predetermined number of colors is completed, the drive control switch 28 is turned over for continuous driving to drive the endless belt 4 continuously.

A printed product 22' is peeled off from the belt 4 below the guide roll 25 and wound by a winding device (not shown).

The belt washing mechanism 24 is actuated by the operation of the drive control switch 28 to wash the belt 4 with water.

After water washing and removal of water, the endless belt 4 is subjected to the paste-applying operation in the pasting operation zone A in the same manner as described above, and a subsequent material to be printed is fed onto the paste-applied endless belt 4 by the sticking roller 23.

In order to enhance the operation efficiency and simplify the operation, it is preferred that peeling of the printed product 22', washing and pasting of the endless belt 4 and application of the material to be printed be sequentially conducted while the endless belt 4 is continuously driven. If desired, however, these operations may be conducted separately by continuously driving the endless belt independently for these operations respectively.

In the foregoing embodiments, printing of one color is accomplished while the endless belt 4 makes one circle of travel. In the present invention, however, there may be adopted a method in which a plurality of printing units 5 are arranged along the lengthwise direction of the apparatus in the printing operation zone and printing of a plurality of colors is performed while the belt 4 makes one circle of travel. In this case, the endless belt 4 is intermittently driven and rotated at the number of times corresponding to the ratio of predetermined print color number/number of printing units. This embodiment is especially advantageous for applying a plurality of color pastes onto a material to be printed in such arrangement that mingling of colors is not substantially caused.

Moreover, there may be adopted a modification in which a combination of a rotary screen and a squeegee is used as the printing unit and the printing operation is carried out while continuously driving the endless belt 4. This printing operation using a rotary screen is especially advantageous for printing of plain cloth, resist printing, discharge printing and printing of continuous patterns such as stripe patterns. If necessary, the rotary screen may be used in combination with a flat screen for the manufacture of printed products.

In the present invention, printing of marks can be performed simultaneously with printing of a first color. In this case, the above-mentioned step (B) for preparation is first conducted, and the mark-printing step (A) and the step of printing of a first color are then conducted simultaneously while driving the belt under digital control. Then, printing of second and subsequent colors is carried out in the same manner as described above with respect to the printing step (C).

What is claimed is as my invention:

1. An automatic screen printing apparatus which comprises:

an endless belt laid out to travel through a pasting operation zone, a printing operation zone, a drying operation zone and a washing operation zone by means of a pair of pulleys, a servo drive mechanism for driving one of said pair of pulleys to thereby drive said endless belt intermittently and continuously around said pair of pulleys, a pasting mechanism disposed in the pasting operation zone so that it can engage with and separate from the endless belt, a mechanism for feeding to the endless belt a material to be printed and having a printing-starting end and applying and sticking the material to the endless belt.

a printing unit disposed in said printing operation zone, said printing unit including a flat screen having a standard end, a squeegee capable of scanning on the screen and a squeegee driving mechanism, said printing unit further comprising a mechanism for printing marks for respective feedings on the surface of the endless belt prior to or simultaneously with printing of a first color, a mark detecting mechanism disposed in the printing operation zone for detecting said feeding marks, a first control mechanism for stopping said servo drive mechanism in response to a signal issued from said mark detecting mechanism to control a repeat length of the endless belt, a lift mechanism for driving and moving the printing unit in a vertical direction between a lowermost printing position and an uppermost non-printing position, a drying device disposed in said drying operation zone, a mechanism for peeling off a printed product from the endless belt, a washing mechanism disposed in the washing operation zone so that it can engage with and separate from the endless belt, a positioning mechanism for correctly registering the printing-starting end of the material to be printed with the standard end of the screen of the printing unit, and a drive control mechanism for continuously driving said servo drive mechanism for applying the whole length of the material to be printed onto the endless belt along a predetermined length prior to printing and, after the application of the material to be printed has been completed, intermittently driving said servo drive mechanism for travelling the endless belt intermittently by a predetermined repeat length along the entire surface of the material to be printed, wherein said mark detecting mechanism comprises a first detecting device to issue signals to said first control mechanism for reducing the speed of the endless belt during periods of intermittent travel thereof, and a second detecting device to issue signals to said first control mechanism for stopping the intermittent travel of the endless belt, wherein said first detecting device is located downstream of said second detecting device in the direction of travel of the endless belt, wherein said pasting mechanism and washing mechanism are connected to said drive control mechanism so that the pasting and washing mechanisms operate on the endless belt only when the endless belt is continuously driven, and wherein said lift mechanism and squeegee driving mechanism are connected to said drive control mechanism so that dropping of the printing unit to the lowermost position is performed on confirmation of the repeat length feeding of the material to be printed, scanning movement of the squeegee is performed on confirmation of completion of dropping of the printing unit to the lowermost position elevation of the printing unit to the uppermost position is performed on confirmation of completion of scanning movement of the squeegee and driving of the endless belt is performed on confirmation of elevation of the printing unit to the uppermost position.

2. An automatic screen printing apparatus which comprises:

an endless belt laid out to travel through a pasting operation zone, a printing operation zone, a drying operation zone and a washing operation zone by means of a pair of pulleys, a servo drive mechanism for driving one of said pair of pulleys to thereby drive said endless belt intermittently and continuously around said pair of pulleys, a pasting mechanism disposed in the pasting operation zone so that it can engage with and separate from the endless belt, a mechanism for feeding to the endless belt, a material to be printed and having a printing-starting end and applying and sticking the material to the endless belt, a printing unit disposed in said printing operation zone, said printing unit including a flat screen having a standard end, a squeegee capable of scanning on the screen and a squeegee driving mechanism, said printing unit further comprising a mechanism for printing marks for respective feedings on the surface of the endless belt prior to or simultaneously with printing of a first color, a mark detecting mechanism disposed in an area adjoining to the printing operation zone, a first control mechanism for stopping said servo drive mechanism in response to a signal issued from said mark detecting mechanism to control a repeat length of the endless belt, a lift mechanism for driving and moving the printing unit in a vertical direction between a lowermost printing position and an uppermost non-printing position, a drying device disposed in said drying operation zone, a mechanism for peeling off a printed product from the endless belt, a washing mechanism disposed in the washing operation zone so that it can engage with and separate from the endless belt, a positioning mechanism for correctly registering the printing-starting end of the material to be printed with the standard end of the screen of the printing unit, and a drive control mechanism for continuously driving said servo drive mechanism for applying the whole length of the material to be printed onto the endless belt along a predetermined length prior to printing and, after the application of the material to be printed has been completed, intermittently driving said servo drive mechanism for travelling the endless belt intermittently by a predetermined repeat length along the entire surface of the material to be printed, wherein said mark detecting mechanism comprises a first detecting device to issue signals to said first control mechanism for reducing the speed of the endless belt during periods of intermittent travel thereof, and a second detecting device to issue signals to said first control mechanism for stopping the intermittent travel of the endless belt, wherein said first detecting device is located downstream of said second detecting device in the direction of travel of the endless belt, wherein said pasting mechanism and washing mechanism are connected to said drive control mechanism so that the pasting and washing mechanisms operate on the endless belt only when the endless belt is continuously driven, and wherein said lift mechanism and squeegee driving mechanism are connected to said drive control mechanism so that dropping of the printing unit to the lowermost position is performed on confirmation of the repeat length feeding of the material to be printed, scanning movement of the squeegee is performed on confirmation of completion of dropping of the printing unit to the lowermost position, elevation of the printing unit to the uppermost position is performed on confirmation of completion of scanning movement of the squeegee and driving of the endless belt is performed on confirmation of elevation of the printing unit to the uppermost position.

* * * * *